US008564499B2

(12) United States Patent
Bateman et al.

(10) Patent No.: US 8,564,499 B2
(45) Date of Patent: Oct. 22, 2013

(54) APPARATUS AND SYSTEM FOR A DOUBLE GIMBAL STABILIZATION PLATFORM

(75) Inventors: Terri Bateman, American Fork, UT (US); Shane Curtis, Provo, UT (US); Katherine Reinke Deason, Mather, CA (US); Erik Hulme, Milton, FL (US); Andrew Orme, Springville, UT (US); Brock Peterson, Bothell, WA (US)

(73) Assignee: Linear Signal, Inc., Spanish Fork, UT (US)

( * ) Notice: Subject to any disclaimer, the term of this patent is extended or adjusted under 35 U.S.C. 154(b) by 282 days.

(21) Appl. No.: 13/077,956

(22) Filed: Mar. 31, 2011

(65) Prior Publication Data

US 2011/0241971 A1 Oct. 6, 2011

Related U.S. Application Data

(60) Provisional application No. 61/319,760, filed on Mar. 31, 2010.

(51) Int. Cl.
*H01Q 3/02* (2006.01)

(52) U.S. Cl.
USPC ..... 343/882; 343/880

(58) Field of Classification Search
USPC ..... 235/705, 882, 765, 766, 757, 880
See application file for complete search history.

(56) References Cited

U.S. PATENT DOCUMENTS

| | | | |
|---|---|---|---|
| 2,410,827 | A | 6/1943 | Langstroth et al. |
| 2,745,098 | A | 5/1945 | Cady |
| 2,472,824 | A | 6/1945 | Hays |
| 2,770,229 | A | 10/1952 | Tarcici |
| 3,166,750 | A | 1/1965 | Ball |
| 3,439,550 | A | 4/1969 | Goulding |
| 3,527,435 | A | 9/1970 | Lapp et al. |
| 4,197,548 | A | 4/1980 | Smith et al. |
| 4,225,868 | A | 9/1980 | Mazur |
| 4,654,670 | A | 3/1987 | Fleming |
| 4,692,771 | A | 9/1987 | Rothbarth et al. |
| 5,153,485 | A | 10/1992 | Yamada et al. |

(Continued)

FOREIGN PATENT DOCUMENTS

| | | |
|---|---|---|
| EP | 1401049 A1 | 3/2004 |
| GB | 890264 | 2/1962 |

(Continued)

OTHER PUBLICATIONS

PCT/US2011/030846, International Search Report and Written Opinion, Sep. 28, 2011.

*Primary Examiner* — Thien M Le
(74) *Attorney, Agent, or Firm* — Kunzler Law Group, PC

(57) ABSTRACT

An apparatus and system are disclosed for a double gimbal stabilization platform. The apparatus, in one embodiment, includes a base and a first pivot joint connected to the base. The apparatus also includes a bent gimbal structure connected to the first pivot joint. The first pivot joint may rotate the bent gimbal structure about a first axis of rotation. The apparatus includes a second pivot joint connected to the bent gimbal structure. The apparatus includes a platform connected to the second pivot joint. The second pivot joint may rotate the platform around a second axis of rotation and the second axis of rotation may be orthogonal to the first axis of rotation. Furthermore, a center of mass for a combination of the bent gimbal structure and the platform may be between the base and the first axis of rotation.

20 Claims, 9 Drawing Sheets

(56) References Cited

U.S. PATENT DOCUMENTS

| | | | | |
|---|---|---|---|---|
| 5,517,205 | A | 5/1996 | van Heyningen et al. | |
| 5,999,139 | A | 12/1999 | Benjamin et al. | |
| 6,034,634 | A | 3/2000 | Karlsson et al. | |
| 6,036,140 | A | 3/2000 | Tranapp et al. | |
| 6,285,338 | B1 * | 9/2001 | Bai et al. | 343/882 |
| 6,285,339 | B1 | 9/2001 | McGill | |
| 6,531,990 | B2 | 3/2003 | Verkerk | |
| 6,842,153 | B2 | 1/2005 | Challoner | |
| 7,095,376 | B1 * | 8/2006 | Timothy et al. | 343/705 |
| 7,239,975 | B2 | 7/2007 | Coleman et al. | |
| 7,548,835 | B2 | 6/2009 | Lin | |
| 2006/0262022 | A1 | 11/2006 | Desargant et al. | |
| 2006/0265120 | A1 | 11/2006 | Coleman et al. | |
| 2008/0001845 | A1 * | 1/2008 | Phelan et al. | 343/882 |
| 2008/0099643 | A1 | 5/2008 | Lin | |
| 2009/0266948 | A1 | 10/2009 | Hanlon et al. | |
| 2010/0265149 | A1 | 10/2010 | Omori et al. | |

FOREIGN PATENT DOCUMENTS

| | | |
|---|---|---|
| GB | 1521228 | 8/1978 |
| GB | 2173347 A | 10/1986 |
| RU | 2251078 | 4/2005 |

* cited by examiner

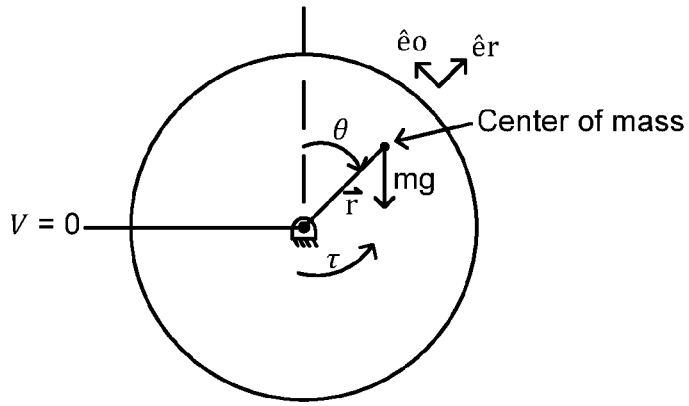

$\vec{r} = y * \hat{e}_r$ $\dot{\vec{r}} = y * \dot{\theta} * \hat{e}_\theta$ $T = ½ * I * \dot{\theta}^2 + ½ * m * \dot{\vec{r}} \cdot \dot{\vec{r}}$ $V = m * g * y * \cos(\theta)$ $L = ½ * I * \dot{\theta}^2 + ½ * m * y^2 * \dot{\theta}^2 - m * g * y * \cos(\theta)$ $\frac{d}{dt}\frac{\partial L}{\partial \dot{\theta}} = I * \ddot{\theta} + m * y^2 * \ddot{\theta}$ $\frac{\partial L}{\partial \theta} = m * g * y * \sin(\theta)$ $Q_\theta = -\tau$ $\boldsymbol{-\tau = I * \ddot{\theta} + m * y^2 * \ddot{\theta} - m * g * y * \sin(\theta)}$ Motor Dynamic Analysis

| Prototype Properties | Top | Bottom |
|---|---|---|
| Moment of Inertia [I] (lb*s^2) | 376.83 | 1247.24 |
| Weight [mg] (lb) | 14.815 | 38.985 |
| Center of Mass Offset [y] (in) | 0.2962 | 0.74 |
| Angle *θ+ (rad) | 0.698 | 0.698 |
| Angular Acceleration *α+(rad/s^2) | 0.172881 | 0.400152 |
| Needed Torque *τ+ (in*lb) | 62.33 | 480.6 |
| Gear Ratio | 2.3 | 6 |
| Motor Torque (in*lb) | 27.1 | 80.1 |
| Time to rotate 40° [t] (s) | 2.841637 | 1.867799 |
| Motor | STP | STP |
| | 34066 | 34127 |

FIG. 11

| Case | Dir | 1 | 2 | Dir II 1 | 2' | (Dir II 1) && 2' | Case Situation |
|---|---|---|---|---|---|---|---|
| 1 | 1 | 1 | 1 | 1 | 0 | 0 | Case 1 will not happen |
| 2 | 1 | 1 | 0 | 1 | 1 | 1 | If moving toward 2 and 1 "high" go toward 2 |
| 3 | 1 | 0 | 0 | 1 | 0 | 0 | If moving toward 2 and 2 "high" go toward 1 |
| 4 | 1 | 0 | 0 | 1 | 1 | 1 | Will move intended direction if neither limit switch high |
| 5 | 0 | 1 | 1 | 1 | 0 | 0 | Case 5 will not happen |
| 6 | 0 | 1 | 0 | 1 | 1 | 1 | If moving toward 1 and 1 "high" go toward 2 |
| 7 | 0 | 0 | 1 | 0 | 0 | 0 | If moving toward 1 and 2 "high" go toward 1 |
| 8 | 0 | 0 | 0 | 0 | 1 | 0 | Will move intended direction if neither limit switch high |

APPARATUS AND SYSTEM FOR A DOUBLE GIMBAL STABILIZATION PLATFORM

CROSS-REFERENCES TO RELATED APPLICATIONS

This application claims the benefit of U.S. Provisional Patent Application No. 61/319,760 entitled "APPARATUS FOR A DOUBLE GIMBAL STABILIZATION PLATFORM" and filed on Mar. 31, 2010 for Terri Bateman et al., which is incorporated herein by reference. This application also incorporates by reference *Antennae Stabilization Platform*, by Shane Curtis, Erik Hulme, Andy Orme, Brock Peterson, Katherine Deason, and Terri Bateman, Apr. 13, 2010, Capstone Program, Fulton College of Engineering and Technology, Brigham Young University.

FIELD OF THE INVENTION

This invention relates to stabilization using gimbals and more particularly relates to a double gimbal stabilization platform.

BACKGROUND

With advances in technology, the world is seeing new methods of communication. In particular, parabolic antennas are becoming outdated and replaced with phased antenna arrays. However, a phased antenna array often needs to remain level with the horizon during operation for communication with various satellites. A phased antenna array also typically needs to maintain an unobstructed field of view.

Furthermore, keeping a phased antenna array level proves difficult when such a phased antenna array is fixed to a ship or an airplane.

SUMMARY

From the foregoing discussion, it should be apparent that a need exists for an apparatus and system that maintains a stable surface to accommodate a phased antenna array. Beneficially, such an apparatus and system would also not encroach upon the phased antenna array's field of view.

The present invention has been developed in response to the present state of the art, and in particular, in response to the problems and needs in the art that have not yet been fully solved by currently available stabilization platforms. Accordingly, the present invention has been developed to provide an apparatus and system for a double gimbal stabilization platform that overcome many or all of the above-discussed shortcomings in the art.

The apparatus, in one embodiment, includes a base and a first pivot joint connected to the base. In one embodiment, the apparatus also includes a bent gimbal structure connected to the first pivot joint. The first pivot joint may rotate the bent gimbal structure about a first axis of rotation. In one embodiment, the apparatus includes a second pivot joint connected to the bent gimbal structure. In one embodiment, the apparatus includes a platform connected to the second pivot joint. The second pivot joint may rotate the platform around a second axis of rotation and the second axis of rotation may be orthogonal to the first axis of rotation. Furthermore, a center of mass for a combination of the bent gimbal structure and the platform may be between the base and the first axis of rotation.

In one embodiment, the bent gimbal structure is outside a field of view of an antenna supported by the platform as the platform rotates about the second axis of rotation. In one embodiment, the bent gimbal structure includes a first curved bar, a second curved bar, a first connecting structure, and a second connecting structure. The first connecting structure may connect the first curved bar to the first pivot joint and the second connecting structure may connect the second curved bar to the first pivot joint. Each end of the first curved bar and the second curved bar may be connected.

In one embodiment, the bent gimbal structure includes a first curved bar including a first center bar connecting a first midpoint of the first curved bar to the first pivot joint. The first midpoint of the first curved bar may be between the base and the first axis of rotation. The bent gimbal structure may also include a first end connecting to the platform and a second end connecting to the platform. The first curved bar may connect the first end to the second end and the first midpoint of the first curved bar may be between the first end and the second end along the first curved bar. The bent gimbal structure may also include a second curved bar including a second center bar connecting a second midpoint of the second curved bar to the first pivot joint on the opposite side of the first pivot joint where the first center bar connects to the first pivot joint. The second midpoint of the second curved bar may be between the base and the first axis of rotation. The second curved bar may connect to the first end and to the second end and the second midpoint of the second curved bar may be between the first end and the second end along the second curved bar.

In a further embodiment, the second pivot joint includes a first pivot sub-joint and a second pivot sub-joint. The first pivot sub-joint may be connected to the first end of the bent gimbal structure and the second pivot sub-joint may be connected to the second end of the bent gimbal structure. In a further embodiment, the first pivot sub-joint connects the first end to the platform at a first location of the platform and the second pivot sub-joint connects the second end to the platform at a second location of the platform opposite the first location.

In one embodiment, the bent gimbal structure is constructed from a first material, the platform is constructed from a second material, and the first material is heavier than the second material. In one embodiment, the apparatus further includes a first rotation power unit for rotating the bent gimbal structure about the first axis of rotation. In one embodiment, the apparatus includes a second rotation unit for rotating the platform about the second axis of rotation.

In one embodiment, the apparatus further includes a platform control unit for controlling the bent gimbal structure as it rotates about the first axis of rotation and controlling the platform as it rotates about the second axis of rotation. In a further embodiment, the platform control unit includes an inertial measurement unit. In one embodiment, the first pivot joint connects to the bent gimbal structure at a center of the bent gimbal structure. In certain embodiments, the platform includes at least one of a plate for supporting a phased antenna array, a phased antenna array, and a wireframe structure for supporting a phased antenna array.

On embodiment of a system is also provided. The system includes a base, a first pivot joint connected to the base, and a bent gimbal structure connected to the first pivot joint. The first pivot joint may rotate the bent gimbal structure about a first axis of rotation. The system also includes a second pivot joint connected to the bent gimbal structure and a platform connected to the second pivot joint. The second pivot joint may rotates the platform about a second axis of rotation and the bent gimbal structure may be outside a field of view of an antenna supported by the platform as the platform rotates about the second axis of rotation. The system may also include a first rotation power unit operationally coupled to the first pivot joint. The first rotation power unit may rotate the bent gimbal structure about the first axis of rotation. The system may also include a second rotation unit operationally coupled to the second pivot joint for rotating the platform about the second axis of rotation. The system may also include a platform control unit in communication with the first rotation power unit and the second rotation unit. The platform control unit may control rotation about the first axis of rotation by way of the first rotation power unit and control rotation about the second axis of rotation by way of the second rotation unit.

In one embodiment, the platform control unit includes an inertial measurement unit. In one embodiment, the platform control unit is coupled to the platform. In one embodiment, the bent gimbal structure extends below the first axis of rotation and the second axis of rotation.

In one embodiment, the second pivot joint includes a first pivot sub-joint and a second pivot sub-joint. The first pivot sub-joint may be connected to a first end of the bent gimbal structure and the second pivot sub-joint may be connected to a second end of the bent gimbal structure. In one embodiment, the first pivot sub-joint connects the first end to the platform at a first location of the platform and the second pivot sub-joint connects the second end to the platform at a second location of the platform opposite the first location.

Another embodiment of an apparatus is provided. The apparatus includes a base, a first pivot joint connected to the base, and a bent gimbal structure connected to the first pivot joint. The bent gimbal structure may include a first end and a second end opposite the first end, wherein the first pivot joint rotates the bent gimbal structure about a first axis of rotation. The apparatus may also include a second pivot joint comprising a first pivot sub-joint and a second pivot sub-joint. The first pivot sub-joint may be connected to the first end of the bent gimbal structure and the second pivot sub-joint may be connected to the second end of the bent gimbal structure. The apparatus may also include a platform connected to the second pivot joint. The first pivot sub-joint may connect the first end to the platform at a first location of the platform and the second pivot sub-joint may connect the second end to the platform at a second location of the platform opposite the first location. The second pivot joint may rotate the platform around a second axis of rotation. The second axis of rotation may be orthogonal to the first axis of rotation. The bent gimbal structure may be outside a field of view of a phased antenna array supported by the platform as the platform rotates about the second axis of rotation.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 11 illustrates one embodiment of a Lagrange Analysis for motor calculations;

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures or materials are not shown or described in detail to avoid obscuring aspects of the invention.

Figure 1:
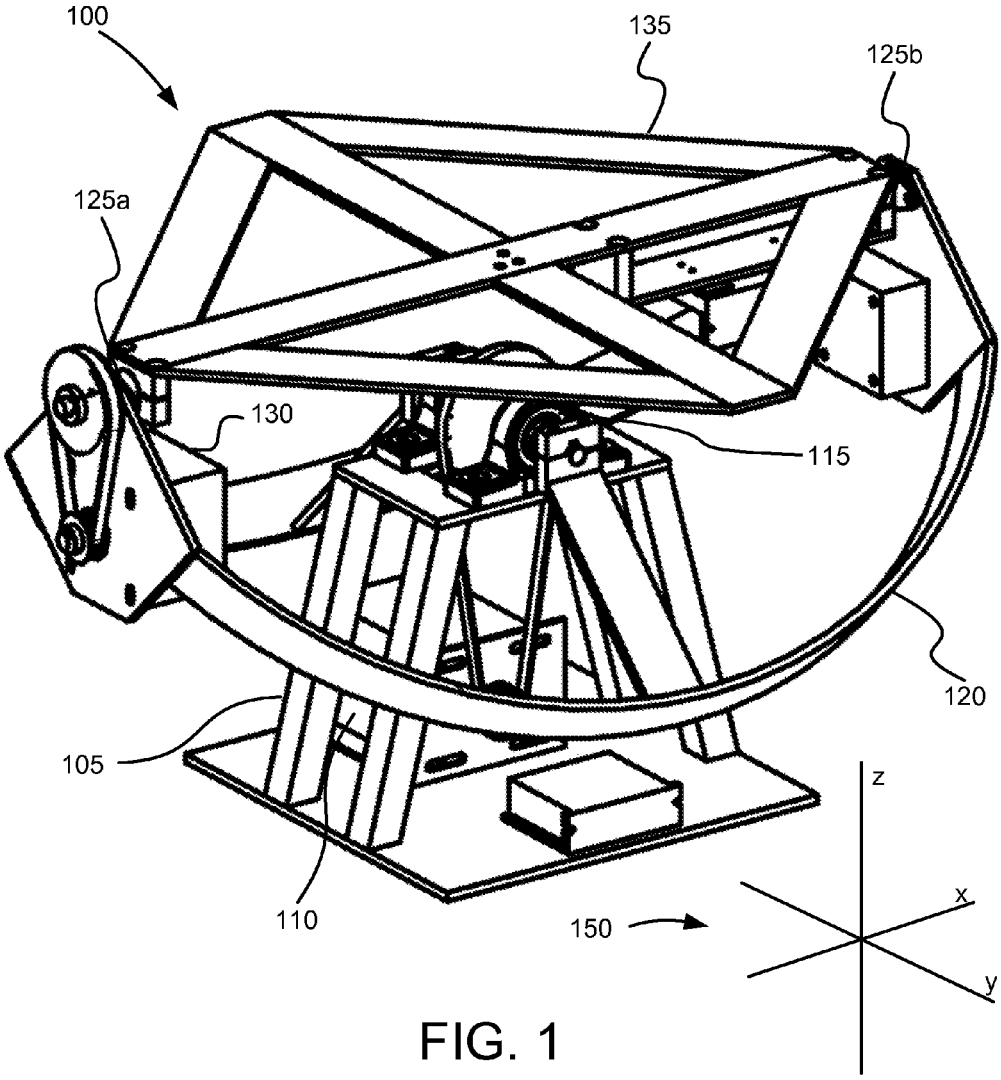
FIG. 1 is a perspective view illustrating one embodiment of an apparatus for a double gimbal stabilization platform in accordance with one representative embodiment.

FIG. 1 illustrates an apparatus for a double gimbal stabilization platform 100 according to one embodiment. The double gimbal stabilization platform 100 may include a base 105, a first rotation power unit 110, a first pivot joint 115, a bent gimbal structure 120, a second pivot joint 125, a second rotation power unit 130, and a platform 135. The double gimbal stabilization platform 100 provides a stabilization platform with a low center of gravity, a low profile, and an unobstructed field of view. The double gimbal stabilization platform 100 may support and stabilize equipment on the platform 135, such as a phased antenna array, although any suitable equipment may be supported by the double gimbal stabilization platform 100. Furthermore, the double gimbal stabilization platform 100 may rotate around a first axis and a second axis in response to both pitch and roll motion. For clarity in defining the orientation of the various components, FIG. 1 also depicts a 3-dimensional coordinate grid 150. The first and second axes about which the platform 100 may rotate (pitch and roll motions) correspond to the 'x' and 'y' axes labeled on the 3-dimensional coordinate grid 150. The vertical axis, labeled 'z' on the grid 150, is the direction in which the base extends. The platform 100 does not rotate about the vertical axis. The bent gimbal structure 120 may connect the platform 135 to the base 105 such that the bent gimbal structure 120 is outside a field of view of a phased array antenna on the platform 135 as the platform 135 rotates about the second axis of rotation.

In one embodiment, the double gimbal stabilization platform 100 is configured to operate within pitch and roll ranges of typical commercial airliner and seafaring vessels. In addition, as described below, the double gimbal stabilization platform 100 may, in certain embodiments, include a platform control unit 1000 to sense accelerations and angular displacement of the platform and stabilize the platform accordingly.

Figure 2:
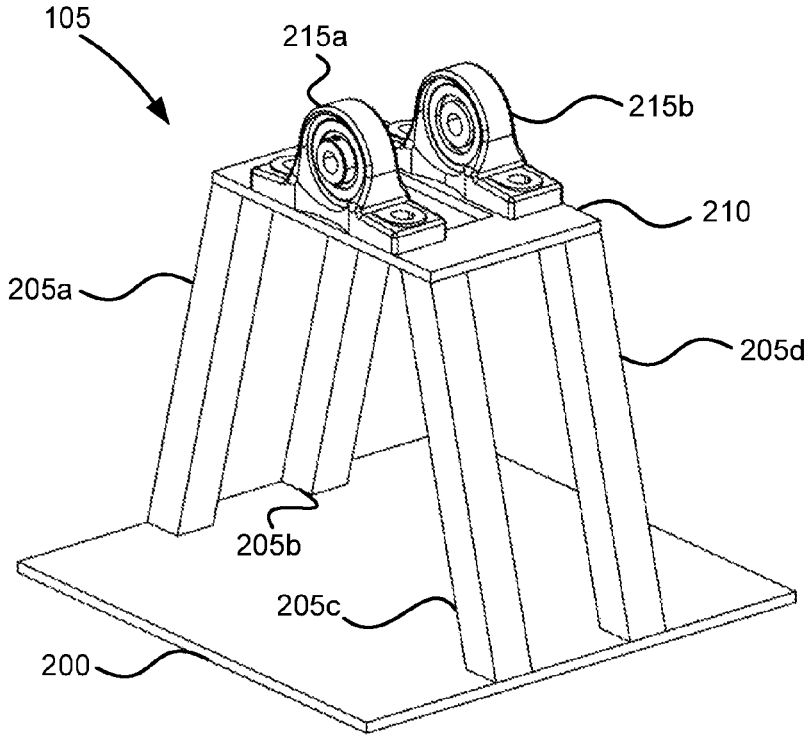
FIG. 2 illustrates a perspective view of a base in accordance with one representative embodiment.

FIG. 2 illustrates a base 105 for the double gimbal stabilization platform 100 according to at least one embodiment. The base 105 may be the base 105 depicted in FIG. 1. In the depicted embodiment, the base 105 includes a lower base plate 200, a plurality of legs 205, an upper base plate 210, and a portion of a first pivot joint 215. The base 105 may function as a means to connect the double gimbal stabilization platform 100 to other components. For example, the base 105 may be secured to the ground, the deck of a ship, a ceiling, a wall, an antenna platform, a plane, and the like. Further, the base 105 may be constructed from material suitable to support other components of the double gimbal stabilization platform 100. For instance, the material used to construct the base 105 may include aluminum, steel, plastic, nylon, Delron®, synthetic materials, and the like. The material used to construct the base 105 may maximize the ratio between the strength of the base 105 and the weight of the base 105.

In at least one embodiment, the plurality of legs 205 extend from the lower base plate 200 and connect to the upper base plate 210. In at least one embodiment, the base 105 may provide space to mount a first rotation power unit 110 as depicted in FIG. 1. The first rotation power unit 110 may control the motion of the bent gimbal structure 120. For example, the first rotation power unit 110 may be a motor, a stepper motor, a manual adjustment mechanism, and the like. A stepper motor may allow stepping motions, as well as high holding torque, which allow the motors to hold a phased antenna array in one position In one embodiment, the first rotation power unit 110 also includes a driver, such as a stepper motor driver, to power the motor. The first rotation power unit 110 may also include pulleys and one or more belts suitable to drive a drive shaft, such as with the first pivot joint 115 as described below. In certain embodiments, the first rotation power unit 110 may mount on the base 105 between the legs 205. In one embodiment, the base 105 includes a bracket, such as on the lower base plate 200, to mount the first rotation power unit 110 to the base 105. In one embodiment, the base 105 may also include a bracket or similar mounting mechanism to mount a driver to power a motor of the first rotation power unit 110.

In certain embodiments, the legs 205 are angled so that the bent gimbal structure 120 can rotate fully without any interference while also providing space for the first rotation power unit 110 to fit underneath the legs 205. Specifically, to provide enough space for the first rotation power unit 110 between the legs 205, the distance between the legs 205 may decrease as the legs 205 move away from the base 105 to the opposite side of the base 105, to minimize the interference of the base 105 with the rotation of the bent gimbal structure 120. In other embodiments, the base 105 may be a wire frame, a post, a column, or combination of elements, etc., that will support a first pivot joint 115, a bent gimbal structure 120, a second pivot joint 125, a platform 135, and other elements of a stabilization platform.

As described above, in one embodiment, the legs 205 attach to an upper base plate 210 as depicted in FIG. 2. In at least one embodiment, the base 105 may connect with the first pivot joint 115 (as depicted in FIG. 1). The first pivot joint 115 may be located at a center location atop the base 105 on the upper base plate 210. Also, the first pivot joint 115 may include a gear, a crank, a motor, a pulley, a shaft, and the like. Further, where the first pivot joint 115 is a shaft, the shaft may be supported by the base 105 and rotate through a series of bearings such as pillow block bearings, needle roller bearings, and the like. FIG. 2 depicts a portion of the first pivot joint 115. Specifically, FIG. 2 depicts a first pillow block bearing 215*a* and a second pillow block bearing 215*b* configured to support a shaft.

Figure 3:
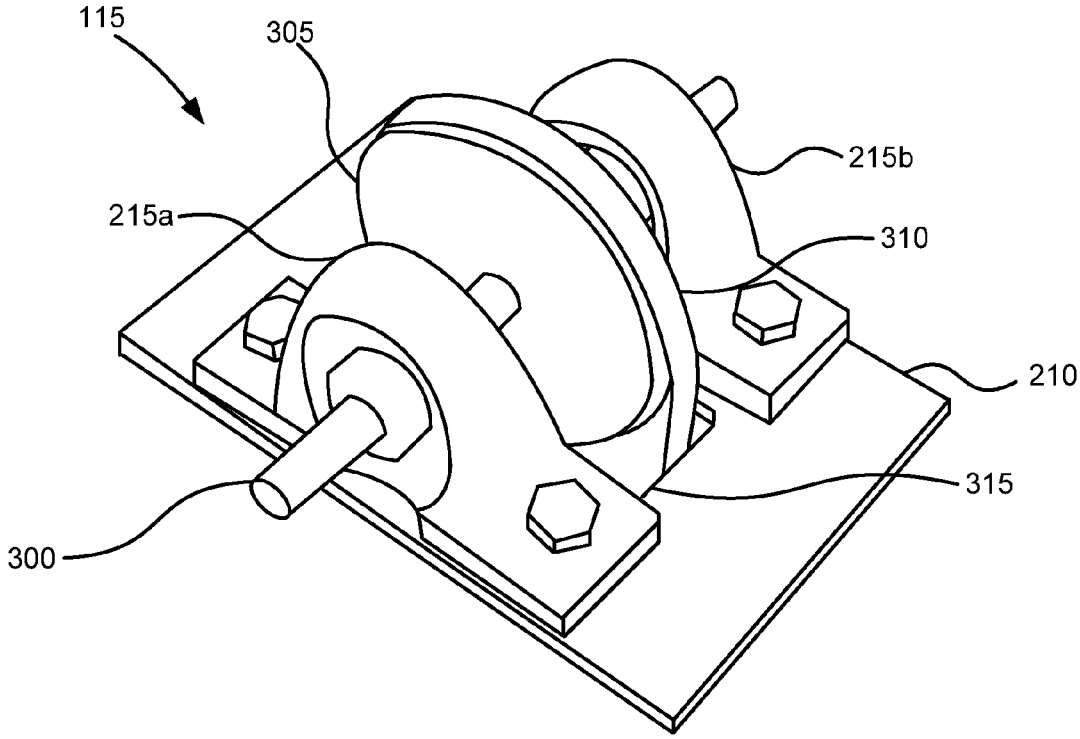
FIG. 3 illustrates a perspective view of a first pivot joint connected to the base of FIG. 2.

FIG. 3 illustrates one embodiment of the first pivot joint 115. The first pivot joint 115 may comprise one embodiment of the first pivot joint 115 of FIG. 1. Specifically, FIG. 3 depicts the upper base plate 210, the first pillow block bearing 215*a*, the second pillow block bearing 215*b*, a shaft 300, a pulley 305, and a belt 310. The first pivot joint 115 may allow the bent gimbal structure 120 to rotate about a first axis of rotation. For example, the first rotation power unit 110 mounted on the base 105 may connect to the first pivot joint 115 with the belt 310. The first rotation power unit 110 may rotate the belt 310, which rotates the pulley 305, shaft 300, and the bent gimbal structure 120 about the first axis of rotation. In certain embodiments, the belt 310 may pass through a slot 315 in the base 105 connecting the rotation power unit to the first pivot joint 115 aligning the motion of the first rotation power unit 110 with the center of mass and increasing stability. Further, the tension in the belt 310 may be adjustable. Alternatively, the first rotation power unit 110 may connect to the first pivot joint 115 with a gear, a plurality of gears, a screw, and the like. In at least one embodiment, the first rotation power unit 110 may include a direct drive that may function as the first pivot joint 115.

Figure 4:
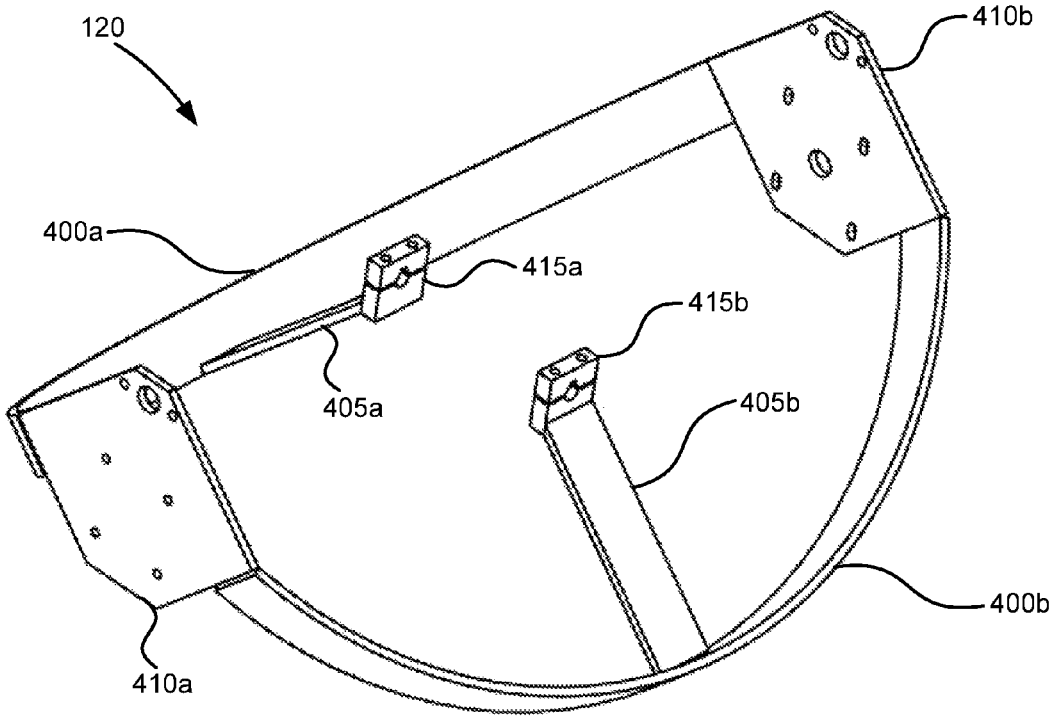
FIG. 4 illustrates a perspective view of a bent gimbal structure in accordance with one embodiment.

FIG. 4 illustrates a perspective view of the bent gimbal structure 120. The bent gimbal structure 120 may allow a phased antenna array to rotate about one of the perpendicular axes of rotation without visual impediments, allowing the phased antenna array to maintain uninterrupted satellite feed. Specifically, the bent gimbal structure 120 may connect the platform 135 to the base 105 such that the bent gimbal structure 120 is outside a field of view of a phased array antenna on the platform 135 as the platform 135 rotates about the second axis of rotation. The field of view of a phased array antenna may include a field of view for the phased array antenna to substantially operate without interruption and/or interference. In one embodiment, the bent gimbal structure 120 extends below (e.g. away from the platform 135) the first axis of rotation and the second axis of rotation. For example, the bent gimbal structure may includes arms (e.g. the first curved bar and the second curved bar described below) that are set at a particular angled pitch off of level. The first axis of rotation and the second axis of rotation are substantially orthogonal to each other and are both substantially orthogonal to the vertical axis (see the coordinate grid 150 depicted in FIG. 1).

Figure 5:
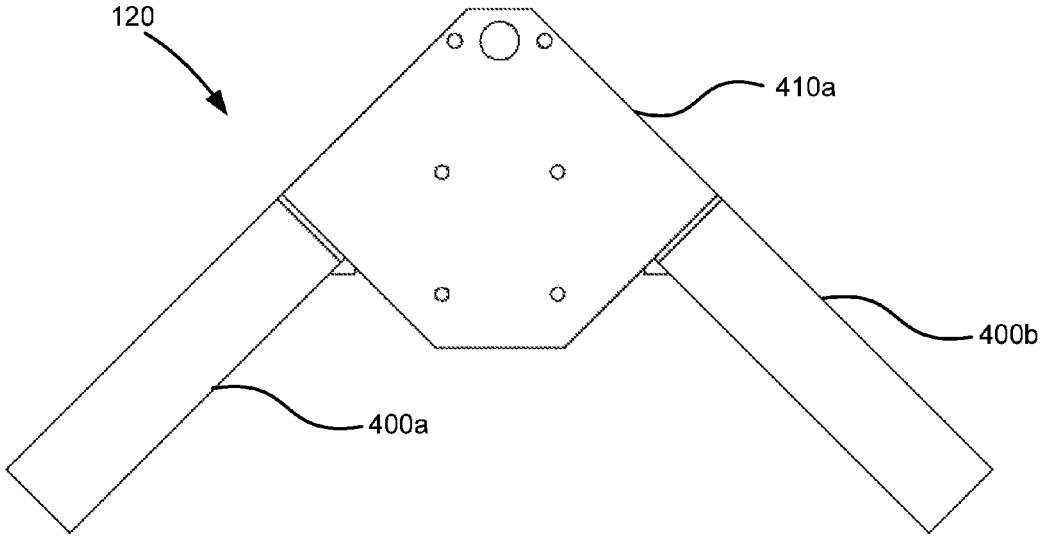
FIG. 5 illustrates a frontal view of the bent gimbal structure of FIG. 4.

The bent gimbal structure 120 may include, in some embodiments, a first curved bar 400*a*, a second curved bar 400*b*, a first connecting structure 405*a*, a second connecting structure 405*b*, a first end 410*a*, and a second end 410*b*. Furthermore, the bent gimbal structure 120 may comprise one embodiment of the bent gimbal structure 120 depicted in FIG. 1. FIG. 5 illustrates a frontal view of the bent gimbal structure 120 of FIG. 4 depicting the first curved bar 400*a* connected to the first end 410*a*, which is connected to the second curved bar 400*b*. FIG. 5 illustrates that, in certain embodiments, the first curved bar and the second curved bar are set at a particular angled pitch off of level. In the depicted embodiment, the first curved bar and the second curved bar are set at a 40° pitch off of level. The pitch off of level may be selected based on a desired range of the platform 135.

Figure 6:
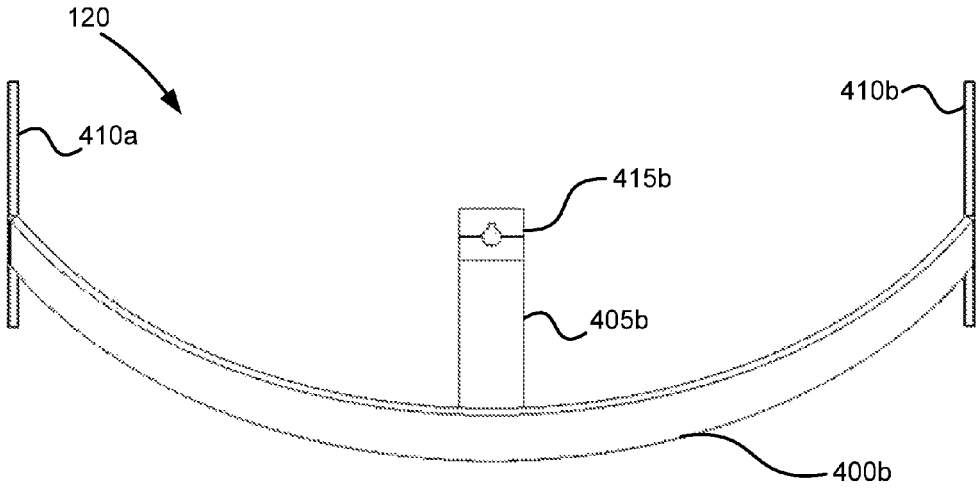
FIG. 6 illustrates a side view of the bent gimbal structure of FIG. 4.

FIG. 6 illustrates a side view of the bent gimbal structure 120 of FIG. 4. FIG. 6 depicts the first end 410*a* connected to the second curved bar 400*b*, which is connected to the second end 410*b*. In addition, the second connecting structure 405*b* is connected to the second curved bar 400*b*.

Referring to FIG. 4 and FIG. 1, in certain embodiments, the first curved bar 400*a* and the second curved bar 400*b* lie on opposite sides of the base 105 and both the first curved bar 400*a* and the second curved bar 400*b* may connect to the first pivot joint 115 as described below. The first curved bar 400*a* and the second curved bar 400*b* may move towards the opposite side of the base 105 from the first pivot joint 115 as the first curved bar 400*a* and the second curved bar 400*b* move away from the first pivot joint 115 along the first axis of rotation. For example, the first curved bar 400*a* and the second curved bar 400*b* may move towards the opposite side of the base 105 from the first pivot joint 115 at substantially a 40° angle as the first curved bar 400*a* and the second curved bar 400*b* move away from the first pivot joint 115 along the first axis of rotation. By moving towards the opposite side of the base 105 from the first pivot joint 115, the bent gimbal structure 120 may avoid interfering with line of site signals that could be received by a phased array attached to the double gimbal stabilization platform 100.

In certain implementations, a required angular range of the double gimbal stabilization platform 100 may vary. For example, a commercial airliner may require an angular range closer to (+/−) 20°. Consequently, in certain embodiments, the first curved bar 400*a* and the second curved bar 400*b* may move towards the opposite side of the base 105 from the first pivot joint 115 at other suitable angles. For example, in one embodiment, the angle may be a 20° angle.

In at least one embodiment, the first curved bar 400*a* and the second curved bar 400*b* of the bent gimbal structure 120 may connect to the first pivot joint 115 through the first connecting structure 405*a* and the second connecting structure 405*b*. In one embodiment, the first connecting structure 405*a* is a first center bar 405*a* and the second connecting structure is a second center bar 405*b*. Further, the first center bar 405*a* and the second center bar 405*b* may extend away from the first pivot joint 115 such that the midpoint of each curved bar 400 is between the first axis of rotation and the side of the base 105 that opposes the first pivot joint 115. Also, the first center bar 405*a* and the second center bar 405*b* may be the same length. For example, two or more spoke-like structures may extend from the first pivot joint 115 to each of the curved bars 400. In the depicted embodiment, the first curved bar 400*a* and the second curved bar 400*b* are connected to a first end 410*a* of the bent gimbal structure 120. Likewise, the first curved bar 400*a* and the second curved bar 400*b* are connected to a second end 410*b* of the bent gimbal structure 120. The first end 410*a* of the bent gimbal structure 120 and the second end 410*b* of the bent gimbal structure 120 may each comprise a plate.

In other embodiments, the first and second curved bars 400*a,b* each connect to the first pivot joint 115 with two or more bars, wires, or other structures. In one embodiment, the ends of the first curved bar 400*a* and the second curved bar 400*b* are connected together. For example, the first curved bar 400*a* may include a first end and a second end, the ends of the second curved bar 400*b* may connect to the first end and the second end of the first curved bar 400*a*. One of skill in the art will recognize other ways to connect the first pivot joint 115 to the curved bars in an economical way that will support the curved bars 400.

The first and second curved bars 400*a,b* in one embodiment are steel bars bent into shape. Steel bars may be used as a cost savings measure. Typically steel bars are relatively easy to bend and are relatively inexpensive and readily available. In another embodiment, the first and second curved bars 400*a,b* are rods, tubes, or the like that are formed into a semi-circular curved structure. In other embodiments, straight bars, rods, etc. are used instead of curved bars. For example, a bar, rod, or other structure may connect to the first pivot joint 115 and may extend down from the first pivot joint 115 toward a bottom of the base 105. Two straight rods, bars, tubes, etc. may then extend to points orthogonal to the first axis of rotation on either side of the first pivot joint 115 where the second pivot joint 125, described below, is located. One of skill in the art will recognize other shapes that will serve to lower a center of gravity of the portion of the antenna supporting structure connected to the first pivot joint 115 and base 105 to a location below the first pivot joint 115 toward where the base 105 connects to another structure.

As described above, the bent gimbal structure 120 may connect to the first pivot joint 115. The first pivot joint 115 may be a shaft mounted to a bearing structure, a hinge, a ball joint, a flexible material, or any other structure that allows the bent gimbal structure 120 to rotate about a first axis. For example, where the first pivot joint 115 is a shaft, the bent gimbal structure 120 may connect to the shaft such that the bent gimbal structure 120 rotates with the shaft.

Figure 7:
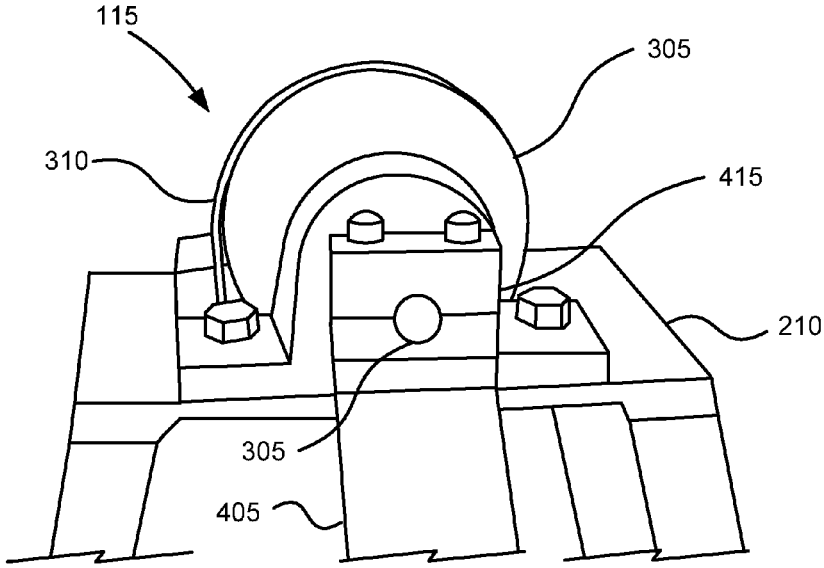
FIG. 7 illustrates a perspective view of a connection between the bent gimbal structure of FIG. 4 and the first pivot joint of FIG. 3 in accordance with one embodiment.

Each of the first center bar 405*a* and the second center bar 405*b* comprise an attachment mechanism 415*a,b* to attach the bent gimbal structure 120 to the first pivot joint 115. In the depicted embodiment, the attachment mechanisms 415 comprise clamps. Referring to FIG. 7, the bent gimbal structure 120 may connect to the first pivot joint 115 (e.g. the shaft 300 with the clamps 415 that cinch the bent gimbal structure 120 to the shaft 300. As described above, each of the first center bar 405*a* and the second center bar 405*b* may connect the first pivot joint 115 to the midpoint of each of the first curved bar 400*a* and the second curved bar 400*b*. FIG. 7 depicts one embodiment of the first pivot joint 115 in which a center bar 405 of the bent gimbal structure 120 attaches to a shaft 300 of the first pivot joint 115 with a clamp.

Referring again to FIG. 4, the bent gimbal structure 120 may reduce the overall height of the double gimbal stabilization platform 100 because, by allowing a platform 135 to be positioned close to the first pivot joint 115 and rotating about a second axis of rotation to where one of the curved bars 400 is located on the bent gimbal structure 120. Also, the bent gimbal structure 120 may avoid contact with the ground or surface to which the base 105 is mounted as the bent gimbal structure 120 rotates about the first axis of rotation. Additionally, since the first curved bar 400*a* and the second curved bar 400*b* are between the first pivot joint 115 and the opposite side of the base 105, the first curved bar 400*a* and the second curved bar 400*b* may move the center of mass of the double gimbal stabilization platform 100 towards the opposite side of the base 105 from the first axis of rotation; the movement of the center of mass may help gravitational forces add natural stability to the double gimbal stabilization platform 100.

Referring also to FIG. 1, the bent gimbal structure 120 may be configured to connect with a platform 135 by a second pivot joint 125 in accordance with one embodiment of the present disclosure. The platform 135 may connect to the bent gimbal structure 120 at a second pivot joint 125 and may further function as an inner gimbal component for the double gimbal stabilization platform 100. The second pivot joint 125 may include rotational points located on the first end 410*a* and the second end 410*b* of the bent gimbal structure 120 that allow the platform 135 to rotate around a second axis of rotation. Specifically, in one embodiment, the second pivot joint 125 includes a first pivot sub-joint 125*a* and a second pivot sub-joint 125*b*. The first pivot sub-joint 125*a* may be connected to the first end 410*a* of the bent gimbal structure 120 and the second pivot sub-joint 125*b* may be connected to the second end 410*b* of the bent gimbal structure 120. Furthermore, the first pivot sub-joint 125*a* may connect the first end 410*a* of the bent gimbal structure 120 to the platform 135 at a first location of the platform 135 and the second pivot sub-joint 125*b* may connect the second end 410*b* of the bent gimbal structure 120 to the platform 135 at a second location of the platform 135 opposite the first location.

The second pivot joint 125 may include joints, hinges, shafts, etc., on the first end 410*a* of the bent gimbal structure 120 and on the second end 410*b* of the bent gimbal structure 120 as illustrated. The second pivot joint 125 is typically at points orthogonal to the first axis of rotation.

In one embodiment, the first pivot sub-joint 125*a* and the second pivot sub-joint 125*b* are not identical but are of different types. The platform 135 may attach to the second pivot joint 125 with keyed bar clamps where the second pivot joint 125 is a series of shafts located at the first end 410*a* and second end 410*b* of the bent gimbal structure 120. In at least one embodiment, the first pivot joint 115 and the second pivot joint 125 may rotate through an angular range of motion. For example, the first pivot joint 115 and the second pivot joint 125 may each rotate through about +/−40° from a center position. In another embodiment, the first pivot joint 115 and the second pivot joint 125 may each rotate through about +/−20° from a center position. The center position for the first pivot joint 115, in one embodiment, is when the first and second center bars 405 of the bent gimbal structure 120 align with the base 105. The center position of the second pivot joint 125, in one embodiment, is when the platform 135 is parallel to the first axis of rotation. The base 105 and other parts of the stabilization platform may be altered, bent, etc. to accommodate other motion ranges and a center of each range may differ from the centers described above.

In certain embodiments, the second pivot joint 125 may also connect to a second rotation power unit 130 that may be located on either the first end 410*a* or second end 410*b* of the bent gimbal structure 120 (e.g. connected to the plate at either the first end 410*a* or the second end 410*b* of the bent gimbal structure 120). For example, the first end 410*a* of the bent gimbal structure 120 may include a drive shaft attached to the platform 135 and a second rotation power unit 130 that controls the rotation of the platform 135 about the drive shaft. Conversely, the second end of the bent gimbal structure 120 may include a passive shaft that allows the platform 135 to freely rotate about the second axis of rotation. Alternatively, the second rotation power unit 130 may also be located on a second end and the passive shaft may be located on a first end of the bent gimbal structure 120. In at least one embodiment, the second pivot joint 125 may include shafts that rotate on flange bearings. Further, the platform 135 may include a counterweight for the second rotation power unit 130 on the platform 135 near the end of the bent gimbal structure 120 that attaches to the second rotation power unit 130. The counterweight may also attach to the bent gimbal structure 120 (e.g. connected to the plate at either the first end or the second end of the bent gimbal structure 120) on the opposite side of the second rotation power unit 130 to add balance to the double gimbal stabilization platform 100. The balancing of the weight may reduce the amount of work needed from the second rotation power unit 130 to stabilize the double gimbal stabilization platform 100. The second rotation power unit 130 may include a direct drive motor, gears, pulleys, belts, or any other means to move the platform 135 about the second axis of rotation. Furthermore, the second rotation power unit 130 may also comprise a motor, stepper motor, and the like similar to the first rotation power unit 110.

Figure 8:
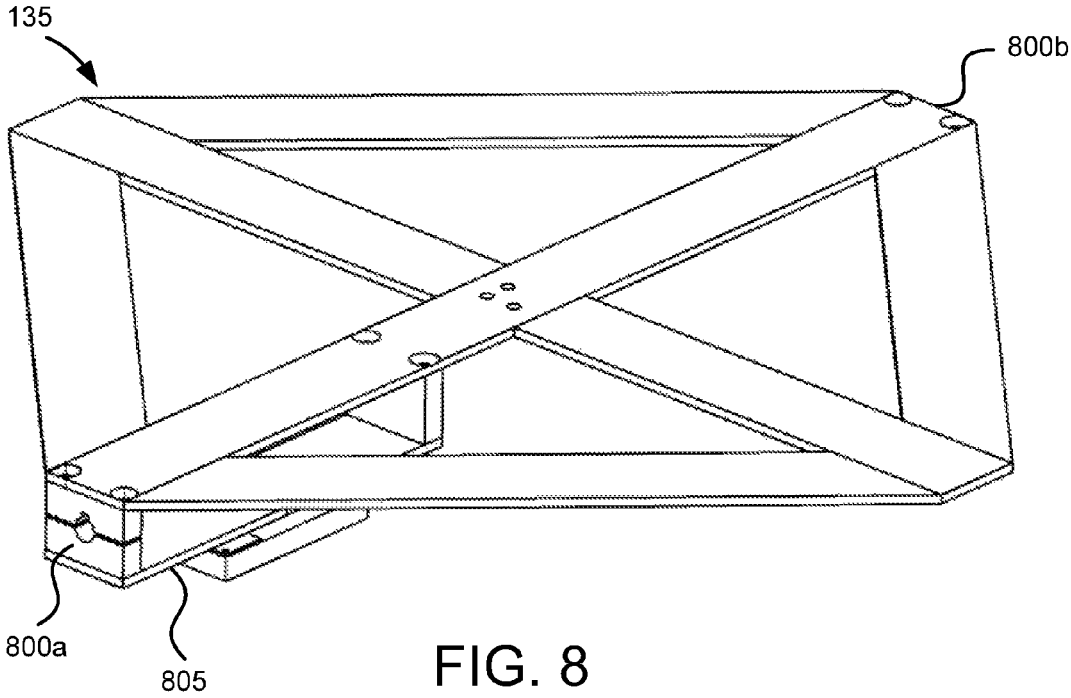
FIG. 8 illustrates a perspective view of platform in accordance with one embodiment.
Figure 9:
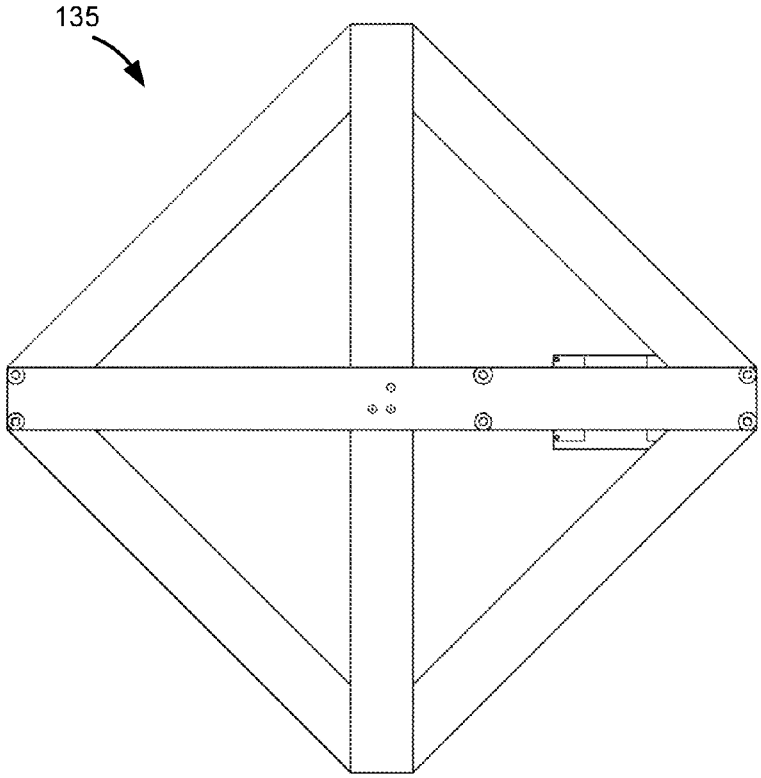
FIG. 9 illustrates a top view of the platform of FIG. 8.

FIG. 8 illustrates a perspective view of platform 135 in accordance with one embodiment and FIG. 9 illustrates a top view of the platform 135 of FIG. 8. The platform 135 may be the platform 135 depicted in FIG. 1. Referring to both FIG. 8 and FIG. 9, in at least one embodiment, the platform 135 may be a plate that supports a phased antenna array. For example, a phased antenna array may mount onto a square metal platform. Alternatively, the platform 135 may be a metal wireframe structure that supports a phased antenna array. For example, as depicted, the platform 135 may include a square frame with a cross pattern connecting the corners of the square frame. Further, the platform 135 may support phased arrays that are large or small.

In the depicted embodiment, the platform 135 includes a first connection mechanism 800*a* and a second connection mechanism 800*b* to connect the platform 135 to the second pivot joint 125. The first connection mechanism 800*a* may connect to the first pivot sub-joint 125*a* and the second connection mechanism 800*b* may connect to the second pivot sub-joint 125*b*. In one embodiment, each connection mechanism 800 may include clamps that cinch the platform 135 to the shafts of the pivot sub-joints 125*a,b*. In one embodiment, the platform 135 may include a bottom attachment mechanism 805 to connect a driver for the second rotation power unit 130. The placement of the driver along an axis of the platform may help center mass and gravity to minimize inertial impacts and stabilization movements reducing the size and power of the rotation power units.

In certain embodiments, the platform 135 may be constructed of metal, plastic, nylon, Delron®, ceramic, other synthetic material, and the like. The material used to construct the platform 135 may also be lighter than the material used to construct the bent gimbal structure 120. For example, the bent gimbal structure 120 may be constructed of iron or steel while the platform 135 may be constructed of aluminum, or a combination of aluminum and other materials. The bent gimbal structure 120 may also be constructed of aluminum while the platform 135 is made of a light synthetic material. In a further embodiment, the platform 135 may comprise the phased antenna array. The phased antenna array may directly connect to the bent gimbal structure 120 and function substantially similar to the platform 135. The phased antenna array may also be lighter than the bent gimbal structure 120. By having the bent gimbal structure 120 lighter than the platform 135, the design helps to move the center of mass for the double gimbal stabilization platform 100 toward a point between the first pivot joint 115 and the side of the base 105 opposite to the first pivot joint 115.

In one embodiment, the platform 135 is more of a plate rather than the structure depicted in FIGS. 8-9. For example, the platform 135 may be a light-weight plastic or similar material. In one embodiment, the platform 135 includes several bars, rods, tubes, wires, etc. connected together. In another embodiment, the platform 135 is formed using a single piece of material that is shaped, cut, milled, etc. to form the platform 135. The platform 135, pivot joints, base 105, bent gimbal structure 120, may be designed and constructed to be light weight compared to other antenna support structures.

Figure 10:
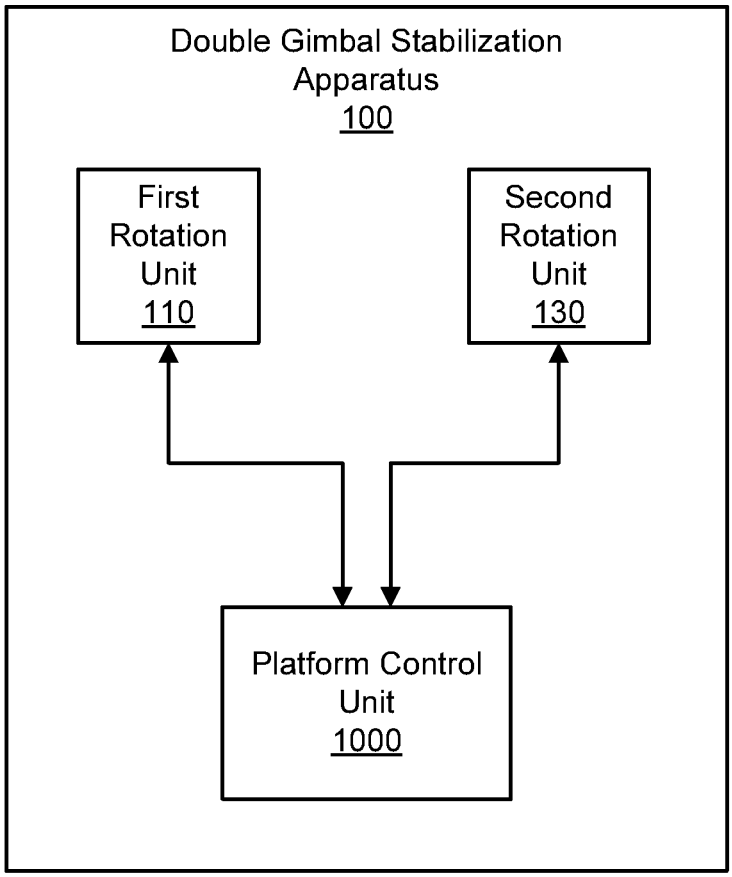
FIG. 10 is a schematic block diagram illustrating a system for supporting an antenna in accordance with one embodiment.

FIG. 10 illustrates one embodiment of the apparatus for a double gimbal stabilization platform 100 with a platform control unit 1000. The apparatus 100 may comprise one embodiment of the double gimbal stabilization platform 100 of FIG. 1. Specifically, in certain embodiments, a platform control unit 1000 may control the movement of the platform 135. In one embodiment, the platform control unit 1000, or a portion of the platform control unit 1000, is coupled to the platform 135.

The platform control unit 1000 may transmit signals to the first rotation power unit 110 and to the second rotation power unit 130 (e.g. through a wired connection to drivers for the first rotation power unit 110 and the second rotation power unit 130). For example, the platform control unit 1000 may include an inertial measurement unit ("IMU") that senses inertial changes and transmits signals to the first rotation power unit 110 and to the second rotation power unit 130 that may keep the platform 135 in a level position regardless of the motion of the double gimbal stabilization platform 100. The platform control unit 1000 may also control the rates of rotation for the first pivot joint 115 and the second pivot joint 125. The platform control unit 1000 may also comprise a computer, a GPS, and the like. In a further embodiment, the platform control unit 1000 may receive feedback from the double gimbal stabilization platform 100. For example, the platform control unit 1000 may detect the status of the first rotation power unit 110 and the second rotation power unit 130. Status may include information about age, wear, efficiency, the rotational position of the first pivot joint 115 and the second pivot joint 125, and the like. In one embodiment, the platform control unit 1000 may steer the platform 135 to be at desired angles that may help a phased array to better receive signals. In one embodiment, the platform control unit 1000 maintains position of an antenna connected to the platform 135 while the base 105 is moved, for example on a vehicle of some type. One of skill in the art will recognize other ways to control movement of the platform 135 with a platform control unit 1000.

In one embodiment, the platform control unit 1000 comprises one or more gyroscopes (e.g. for x-axis, y-axis, and/or z-axis measurements), one or more accelerometers, and/or one or more processors. From the measurements of accelerations and rates of rotation, the platform control unit 1000 calculates the roll and pitch (angular displacement about x- and y-axis, respectively) of the platform 135, interprets the data, and sends direction and signals to the rotation power units (e.g. to the drivers of the rotation power units). In one embodiment, the platform control unit 1000 uses an Extended Kalman Filter ("EKF") to measure acceleration and rates of rotation.

The platform control unit 1000 may allow for recalibration to the level position. This can be done by allowing the platform control unit 1000 to center at its zero position and measuring angular displacement with a level. The angular offset can then be included in the firmware code. One embodiment of platform control unit code, written in "C," is included as Appendix.

The platform control unit 1000 may use the measured pitch and roll, provided by the EKF, as well as a control structure to find which signals to send to the first rotation power unit 100 and the second rotation power unit 130. In one embodiment, the platform control unit 1000 uses a relative coordinate system and not an absolute coordinate system. For example, it finds the angular displacement of the platform control unit 1000 in relation to the gravity vector, instead of the displacement in relation to the lower platform as well as the gravity vector.

In one embodiment, the platform control unit 1000 includes a Proportional Integral-Derivative ("PID") controller, which dynamically adjusts the speed of the rotation power units (e.g. motors) depending on how much rotation is required to obtain equilibrium.

Referring also to FIG. 1, in one embodiment, the double gimbal stabilization platform 100 includes one or more limit switches. For example, a limit switch may be mounted so that when the bent gimbal structure 120 reaches an end point, the limit switch sends a signal to shut off the first rotation power unit 110 to prevent the bent gimbal structure 120 from moving beyond the end point. Limit switches may also be used to prevent the platform 135 from moving beyond intended end points. In other embodiments, the double gimbal stabilization platform 100 includes stops, bumpers, limiting hardware, etc. to limit a range of motion of the platform 135 and/or the bent gimbal structure 120. For example, the platform 135 may reach a stop, such as a rubber bumper, plastic bumper, or other mechanism designed to prevent the platform 135 from moving beyond an end point and the platform control unit 1000 may sense an increased motor current, increased torque, etc. and may determine that the platform 135 has reached an end point.

In one embodiment, limit switches help prevent damage to the double gimbal stabilization platform 100 in extreme conditions. These physical switches may be placed on the curved bars where the top platform 135 would touch and on the base legs where a bar attached to the lower rotating joint would touch before it touches the ground. When one of these switches is touched, in one embodiment it reverses the direction signal from the platform control unit 1000 making the rotating joint reverse until the switch is no longer engaged. Therefore, when an extreme condition is met that rotates the design over 40 degrees, it will simply oscillate at its maximum limit without harming any of the hardware or electronics until it is restored to normal conditions where it will stabilize normally.

An end point may be a point where motion of the platform 135 and/or the bent gimbal structure 120 is intended to stop. Moving beyond an end point may cause damage, may cause an energy loss, may cause a motor to be damages, etc. Moving beyond an end point may also be undesirable because the movement may position the double gimbal stabilization platform 100 beyond where the antenna of the platform 135 will function properly. One of skill in the art will recognize other reasons for an end point and other ways to stop motion of elements of the double gimbal stabilization platform 100.

FIG. 11 depicts one embodiment of a Lagrange Analysis for motor calculations. In one embodiment, the actuation devices for the assembly 100 are stepper motors. Stepper motors in some embodiments are chosen over conventional direct current ("DC") motors because of their discretized stepping motions, as well as high holding torque, which allow the motors to hold the phased array in one position (parallel with the horizon). In one embodiment, Motor specifications for one embodiment for both the lower and upper motors are included in Table 1 below. The Lagrange analysis of FIG. 11 is used to determine the values shown in Table 1, as one example.

TABLE 1

| Motor Specification | Lower Motor | Upper Motor |
|---|---|---|
| Vendor | Automation Direct | Automation Direct |
| Model # | STP-MTRH-34127 | STP-MTR-34066 |
| Holding Torque (oz-in) | 1290 | 434 |
| Minimum Steps/Revolution | 200 | 200 |
| Amps/Phase | 6.3 | 2.8 |

For the embodiment, a dynamic analysis on the motors and gearing was performed on the stabilization platform assembly 100 to determine that the platform meets criteria of Table 2 below.

TABLE 2

| Metric # | Metric | Units | Marginal Value | Target Value |
|---|---|---|---|---|
| 2.1 | Operate within typical airline/ maritime conditions - Angular Range | degrees | (+/−)20 | (+/−)20 |
| 2.2 | Operate within typical airline/ maritime conditions - Angular Velocity Response | degrees/sec | >40 | 80 |

TABLE 2-continued

| Metric # | Metric | Units | Marginal Value | Target Value |
|---|---|---|---|---|
| 5.3 | Operate within typical airline/ maritime conditions - Maximum Lateral Acceleration | g | 2 | 2 |

One of skill in the art will recognize that other motors may meet the criteria in Table 2 and that other criteria may be chosen.

Figure 12:
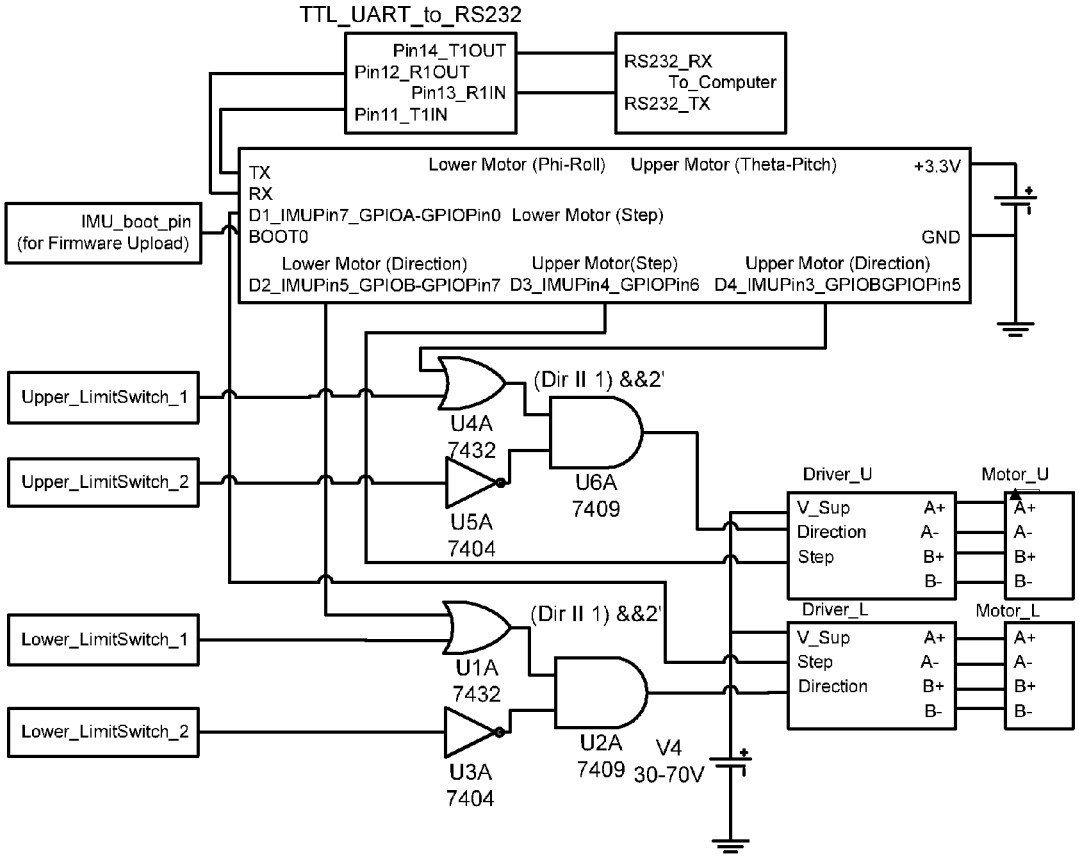
FIG. 12 illustrates one embodiment of an electrical circuit schematic for the platform control unit assuming an IMU with four available input/output ("IO") pins.

FIG. 12 depicts one embodiment of an electrical circuit schematic for the platform control unit 1000 assuming an IMU with four available input/output ("IO") pins. FIG. 12 depicts conditions such that if the direction ("Dir") is "logic high", the platform 135 is moving towards switch 2, and if "Dir" is "logic low", the platform 135 is moving towards switch 1.

For example, case 3 shows the platform 135 moving towards switch 2 and that switch 2 is pressed which makes the "Dir" signal change to "logic low" and the platform 135 go the opposite direction for that step. As previously mentioned, the limit switches prevent the rotation power units 110,130 from going beyond their allotted (e.g. +/−40°) rotation. In an alternate embodiment, the platform control unit 1000 includes additional circuitry (e.g. a second IMU on the bottom platform), to limit the platform's 135 movement.

Figure 13:
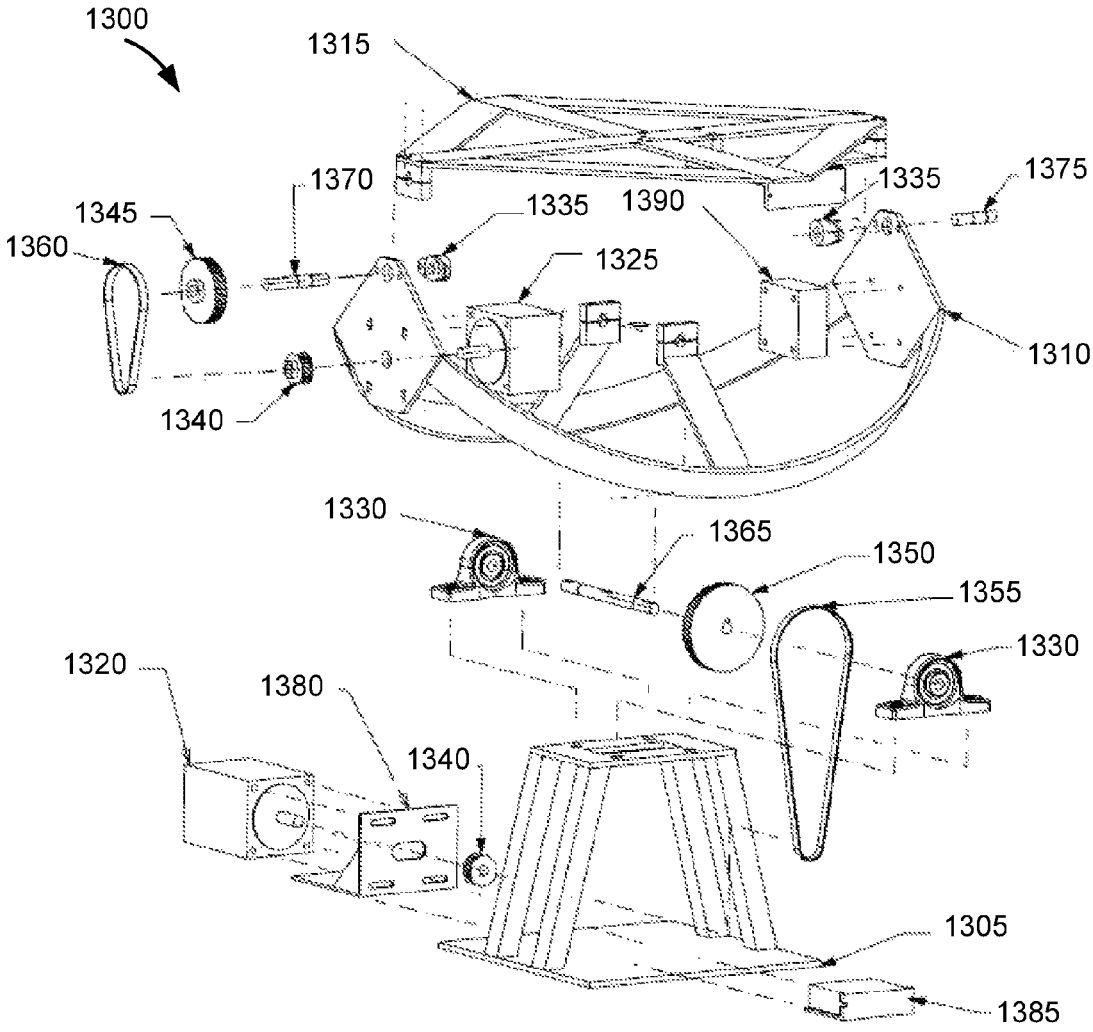
FIG. 13 illustrates a parts assembly diagram for one embodiment of the double gimbal stabilization platform.

FIG. 13 is a parts assembly diagram for one embodiment of the double gimbal stabilization platform 100. FIG. 13 includes the base 1305, the bent gimbal structure 1310, the platform 1315, the first rotational power unit 1320, the second rotational power unit 1325, pillow bearings 1330, flange bearings 1335, a small pulley 1340, a medium pulley 1345, a large pulley 1350, a long belt 1355, a short belt 1360, a lower drive shaft 1365, an upper drive shaft 1370, an upper passive shaft 1375, a motor bracket 1380, a lower driver 1385, and a counter weight 1390.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

APPENDIX

```
/* ----------------------------------------------------------------------------------------
    File: team20_motor_dirstep.c
    Author: Brock Peterson - Capstone - Team 20 - Satellizers
    Collaborating with Linear Signal
    Version: 1.0
    Description: Motor Direction and Step signals that will be sent to motor
    drivers.
    Includes: Additions to files included in IMU firmware for program implementation
----------------------------------------------------------------------------------------
***********Added to chr6d_startup.c************************
*******added just after these lines of code**
    TIM_TimeBaseStructure.TIM_Period = 0xFFFF;
    TIM_TimeBaseStructure.TIM_Prescaler = 64;
    TIM_TimeBaseStructure.TIM_ClockDivision = 0;
    TIM_TimeBaseStructure.TIM_CounterMode = TIM_CounterMode_Up;
    TIM_TimeBaseInit(TIM3, &TIM_TimeBaseStructure);
***** (also, the last 5 lines were simply modified do all be set to 'low' logic)
    // Modifications made to next 7 lines of executed code added by Brock Peterson March 2010
    // Get elapsed time since last motor use (Timer4 should be configured
    // to increment once every microsecond. It is a 16-bit timer, which means
    // that a maximum of 2^16 = 65536 microseconds can pass before overflow.
    // The motor updates should thus be run at least once every 65 milliseconds (15.6 Hz),
```

APPENDIX-continued

```
    // but preferably more quickly. This shouldn't be a problem - the motor updates
    // should nominally run at roughly 400 Hz or greater, whether updating pins or not.
    // Configure Timer4 for motor time differences using TIM3
    TIM-TimeBaseInit(TIM4, &TIM_TimeBaseStructure);
    // Pull Self-Test pin low
    GPIO_WriteBit( GPIOA, GPIO_Pin_13, Bit_RESET );
    GPIO_WriteBit( GPIOA, GPIO_Pin_0, Bit_RESET ); //All four output pins set to 'low'.
    GPIO_WriteBit( GPIOB, GPIO_Pin_5, Bit_RESET ); //Driver uses 'high' = 4V or more
    GPIO_WriteBit( GPIOB, GPIO_Pin_6, Bit_RESET ); // and 'low' = 0.8V or less.
    GPIO_WriteBit( GPIOB, GPIO_Pin_7, Bit_RESET ); //However, IMU out is sufficient
    //i.e.: 0V = 'low', 3.3V = 'high'
***********until here*************************************
***********Modified in chr6d_config.h**********************
******Note: this is a .h file, not .c (will not show up in ride7 software project file list)
******(these were modified because these hex addresses were in page 31 or 32
*******and were being overwritten during the firmware write process. The new
*******page number is around page 48. See STMFlash Loader Demonstrator steps
*******in order to view the page numbers for reference.
    #define OFFSET_CONF1_ADDR (uint32_t)0×0800C000
    #define OFFSET_CONF2_ADDR (uint32_t)0×0800C004
    #define OFFSET_CONF3_ADDR (uint32_t)0×0800C008
    #define FIR_CONF_ADDR (uint32_t)0×0800C00C
    #define FIR_TAP_CONF_ADDR (uint32_t)0×0800C010
    #define USART_CONF_ADDR (uint32_t)0×0800C014
    #define PROCESS_NOISE_ADDR (uint32_t)0×0800C018
***********until here*************************************
***********Added to main.c*********************************
*****added to include section
    #include "team20_motor_dirstep.h"
*****added to define section
    static uint16_t wait_time;
    uint16_t timer_value;
*****added just before while(1) program loop
    //Reset gyros to zero at startup
    StartGyroCalibration( );
    // Start timer4 for motor signal difference tracking
    // i.e.: the difference between DIR and STEP need to be 5us and the drivers
    // can only accept up to 3kHz (not actual numbers, just an example).
    TIM_SetCounter(TIM4,0);
    TIM_Cmd(TIM4, ENABLE);
    //used for initial pause of 3s
    wait time = 0;
*****added to first section of while(1) program loop
    TIM_Cmd(TIM4, DISABLE);
    timer_value = TIM_GetCounter(TIM4)
    if ( ( timer_value > 50000) && ( wait_time < 60) )
    { // This timer_value is set to 50000us or 50ms...changed after last IMU firmware update
    // This TIMER helps make the IMU have an initial state before starting to send signals
    // to the drivers/motors since some drivers require a short startup time before working
        TIM_SetCounter(TIM4,0);
        wait_time = wait_time + 1;
    }
    TIM_Cmd(TIM4, ENABLE);
*****added to end of if( new_data ) section of while(1) program loop
    if ( wait_time >= 1200 )
    {
        MOTOR_DirStep( &gEstimatedStates );
    }
************until here*************************************
------------------------------------------------------------------------- */
#include <math.h>
#include <time.h>
#include "stm32f10x.h"
#include "chr6d_states.h"
#include "matrix3×3.h"
#include "team20_motor_dirstep.h"
AHRS_states gEstimatedStates;
/*************************************************************************
*
* Function Name : MOTOR_DirStep
* Input : None
* Output : None
* Return : None
* Description : Uses an AHRS_states structure to calculate if a change in
direction or a step pulse is needed. Applies the appropriate values, then
returns the step pins to their original states.
*************************************************************************
*/
void MOTOR_DirStep( AHRS_states* estimated_states )
{
```

APPENDIX-continued

```
// 3.14159 is used in place of pi
//IMU schematic pin 5 is Motor_upper_Dir = GPIOB - GPIO_Pin_7 - theta
//IMU schematic pin 7 is Motor_upper_Step = GPIOA - GPIO_Pin_0 - theta
//IMU schematic pin 3 is Motor_lower_Dir = GPIOB - GPIO_Pin_5 - phi
//IMU schematic pin 4 is Motor_lower_Step = GPIOB - GPIO_Pin_6 - phi
//Roll (phi) is about the y-axis on IMU, which is the lower driver/motor
//Pitch (theta) is about the x-axis on IMU, which is the upper driver/motor
float theta_mag = estimated_states->theta;
float phi_mag = estimated_states->phi;
uint16_t phi_time = 0;//added by Brock Peterson 6-Apr-2010
uint16_t theta_time = 0;
uint16_t theta_steps = 0;
uint16_t phi_steps = 0;
int theta_step_time = 2000;
int_phi step_time = 1700;
//IMU Calibration for new center axis
if ( PITCH_CAL_NEGATIVE ) //upper
    theta_mag = theta_mag - PITCH_CALIBRATION;
else
    theta_mag = theta_mag + PITCH_CALIBRATION;
if ( ROLL_CAL_NEGATIVE ) //lower
    phi_mag = phi_mag - ROLL_CALIBRATION;
else
    phi_mag = phi_mag + ROLL_CALIBRATION;
//Changes center from 180 to 0 degrees
if ( theta_mag > 100 ) //upper
    { theta_mag = theta_mag - 180; }
else if ( theta_mag < -100 )
    { theta_mag = theta_mag + 180; }
if ( phi_mag > 100 ) //lower
    { phi_mag = phi_mag - 180; }
else if ( phi_mag < -100 )
    { phi_mag = phi_mag + 180; }
//Sets direction pins
if ( theta_mag > 0) //upper
    ( GPIO_WriteBit( GPIOB, GPIO_Pin_7, Bit_RESET ); PAUSE_DIRTOSTEP( ); }
else
    ( GPIO_WriteBit( GPIOB, GPIO_Pin_7, Bit_SET ); PAUSE_DIRTOSTEP( ); theta_mag =
    theta_mag*-1; }
if ( phi_mag > 0) //lower
    ( GPIO_WriteBit( GPIOB, GPIO_Pin_5, Bit_RESET ); PAUSE_DIRTOSTEP( ); }
else
    ( GPIO_WriteBit( GPIOB, GPIO_Pin_5, Bit_SET ); PAUSE_DIRTOSTEP( ); phi_mag =
    phi_mag*-1; }
if ( phi_mag > 0.5 )
{
    if ( phi_mag > 1 )
    {
        if ( phi_mag > 2 )
        {
            if ( phi_mag > 3 )
            {
                if ( phi_mag > 3.5 )
                {
                    if ( phi_mag > 4 )
                    {
                        phi_steps = phi_steps + 3;
                        phi_step_time = phi_step_time - 200; //gives 1kHz signal
                    }
                    phi_steps = phi_steps + 2;
                    phi_step_time = phi_step_time - 300; //gives 833Hz signal
                }
                phi_steps = phi_steps + 1;
                phi_step_time = phi_step_time - 500; //gives 666Hz signal
            }
            phi_steps = phi_steps + 1;
        }
        phi_steps = phi_steps + 1;
    }
}
if ( theta_mag > 0.5 )
{
    if ( theta_mag > 1 )
    {
        if ( theta_mag > 2 )
        {
            if ( theta_mag > 3 )
            {
                if ( theta_mag > 3.5 )
                {
```

APPENDIX-continued

```
                    if ( theta_mag > 4 )
                    {
                        theta_steps = theta_steps + 3;
                        theta_step_time = theta_step_time - 100; //gives 1.111kHz signal
                    }
                    theta_steps = theta_steps + 2;
                    theta_step_time = theta_step_time - 200; //gives 1kHz signal
                }
                theta_steps = theta_steps + 1;
                theta_step_time =theta_step_time - 300; //gives 833Hz signal
            }
            theta_steps = theta_steps + 1;
            theta_step_time = theta_step_time - 500; //gives 667Hz signal
        }
        theta_steps = theta_steps + 1;
    }
}
while ( ( theta_steps > 0 ) || ( phi_steps > 0) )
{
    if ( ( theta_steps > 0) && ( theta_time > theta_step_time ) )
    {
        theta_time = 0;
        TIM_Cmd(TIM4, DISABLE);
        phi_time = phi_time + TIM_GetCounter(TIM4);
        TIM_SetCounter(TIM4,0);
        TIM_Cmd(TIM4, ENABLE);
        STEP_THETA( );
        theta_steps = theta_steps - 1;
    }
    if ( ( phi_steps > 0) && ( phi_time > phi_step_time ) )
    {
        TIM_Cmd(TIM4, DISABLE);
        theta_time = theta_time + TIM_GetCounter(TIM4);
        TIM_SetCounter(TIM4,0);
        TIM_Cmd(TIM4, ENABLE);
        phi_time = 0;
        STEP_PHI( );
        phi_steps = phi_steps - 1;
    }
    TIM_Cmd(TIM4, DISABLE);
    phi_time = phi_time + TIM_GetCounter(TIM4);
    theta_time = theta_time + TIM_GetCounter(TIM4);
    TIM_SetCounter(TIM4,0);
    TIM_Cmd(TIM4, ENABLE);
    }
}
/*****************************************************************************
*
* Function Name : STEP_THETA
* Input : None
* Output : None
* Return : None
* Description : Sends a step signal to the theta driver
*****************************************************************************
*/
void STEP_THETA( )
{
    GPIO_WriteBit( GPIOA, GPIO_Pin_0, Bit_SET );
    PAUSE_PULSEW IDTH( );
    GPIO_WriteBit( GPIOA, GPIO_Pin_0, Bit_RESET );
}
/*****************************************************************************
*
* Function Name : STEP_PHI
* Input : None
* Output : None
* Return : None
* Description : Sends a step signal to the phi driver
*****************************************************************************
*/
void STEP_PHI( )
{
    GPIO_WriteBit( GPIOB, GPIO_Pin_6, Bit_SET );
    PAUSE_PULSEW IDTH( );
    GPIO_WriteBit( GPIOB, GPIO_Pin_6, Bit_RESET );
}
/*****************************************************************************
*
* Function Name : SLEEP_PULSEWIDTH
* Input : None
```

APPENDIX-continued

```
* Output : None
* Return : None
* Description : Holds at the current position for duration of pulsewidth
*******************************************************************************
*/
void SLEEP_PULSEWIDTH( )
{
	int delay = 0;
	while ( delay < 1000 )
	{
		delay = delay + 1;
	}
}
/*******************************************************************************
*
* Function Name : SLEEP_DIRTOSTEP
* Input : None
* Output : None
* Return : None
* Description : Holds at the current position for duration of pulsewidth
*******************************************************************************
*/
void SLEEP_DIRTOSTEP( )
{
	int delay = 0;
	while ( delay < 1000 )
	{
		delay = delay + 1;
	}
}
/*******************************************************************************
*
* Function Name : PAUSE_DIRTOSTEP
* Input : None
* Output : None
* Return : None
* Description : Calls SLEEP_DIRTOSTEP for clean code
*******************************************************************************
*/
void PAUSE_DIRTOSTEP( )
{
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );
	SLEEP_DIRTOSTEP( );//2150ns or 2.15us
}
/*******************************************************************************
*
* Function Name : PAUSE_PULSEWIDTH
* Input : None
* Output : None
* Return : None
* Description : Calls SLEEP_PULSEWIDTH for clean code
*******************************************************************************
*/
void PAUSE_PULSEWIDTH( )
{
	SLEEP_PULSEWIDTH( );
	SLEEP_PULSEWIDTH( );
	SLEEP_PULSEWIDTH( );
	SLEEP_PULSEWIDTH( );
	SLEEP_PULSEWIDTH( );
	SLEEP_PULSEWIDTH( );
	SLEEP_PULSEWIDTH( );
	SLEEP_PULSEWIDTH( );
	SLEEP_PULSEWIDTH( );//2150ns or 2.15us
}
/*******************************************************************************
*
* Function Name : PAUSE_STEPTIME
```

APPENDIX-continued

```
* Input : None
* Output : None
* Return : None
* Description : Calls SLEEP_STEPTIME for clean code
*****************************************************************************
*/
void PAUSE_STEPTIME( )
{
    // pauses for 0.5ms
    int timer_value;
    float T;
    TIM_Cmd(TIM4, DISABLE);
    TIM_SetCounter(TIM4,0);
    TIM_Cmd(TIM4, ENABLE);
    timer_value = TIM_GetCounter(TIM4);
    T = (float)(0.000001)*(float)timer_value;
    while( T < 0.0005 ) //0.5ms
    {
        timer_value = TIM_GetCounter(TIM4);
        T = (float)(0.000001)*(float)timer_value;
    }
}
```

What is claimed is:

1. An apparatus for supporting an antenna comprising:

a base comprising a vertical axis;

a first pivot joint connected to the base;

a bent gimbal structure connected to the first pivot joint, wherein the first pivot joint rotates the bent gimbal structure about a first axis of rotation and the first axis of rotation is substantially orthogonal to the vertical axis, wherein the bent gimbal structure does not rotate about the vertical axis;

a second pivot joint connected to the bent gimbal structure; and a platform connected to the second pivot joint, wherein the second pivot joint rotates the platform about a second axis of rotation, wherein the second axis of rotation is substantially orthogonal to both the first axis of rotation and the vertical axis, wherein the platform does not rotate about the vertical axis and the center of mass for the combination of the bent gimbal structure and the platform is between the base and the first axis of rotation.

2. The apparatus of claim 1, wherein the bent gimbal structure is outside a field of view of an antenna supported by the platform as the platform rotates about the second axis of rotation.

3. The apparatus of claim 1, wherein the bent gimbal structure comprises a first curved bar, a second curved bar, a first connecting structure, and a second connecting structure, wherein the first connecting structure connects the first curved bar to the first pivot joint and second connecting structure connects the second curved bar to the first pivot joint, and wherein each end of the first curved bar and the second curved bar are connected.

4. The apparatus of claim 1, wherein the bent gimbal structure comprises:

a first curved bar comprising:

a first center bar connecting a first midpoint of the first curved bar to the first pivot joint, wherein the first midpoint of the first curved bar is between the base and the first axis of rotation;

a first end connecting to the platform; and a second end connecting to the platform, wherein the first curved bar connects the first end to the second end, wherein the first midpoint of the first curved bar is between the first end and the second end along the first curved bar; and a second curved bar comprising a second center bar connecting a second midpoint of the second curved bar to the first pivot joint on the opposite side of the first pivot joint where the first center bar connects to the first pivot joint, wherein the second midpoint of the second curved bar is between the base and the first axis of rotation, the second curved bar connecting to the first end and to the second end, wherein the second midpoint of the second curved bar is between the first end and the second end along the second curved bar.

5. The apparatus of claim 4, wherein the second pivot joint comprises a first pivot sub-joint and a second pivot sub-joint, the first pivot sub-joint connected to the first end of the bent gimbal structure and the second pivot sub-joint connected to the second end of the bent gimbal structure.

6. The apparatus of claim 5, wherein the first pivot sub-joint connects the first end to the platform at a first location of the platform and the second pivot sub-joint connects the second end to the platform at a second location of the platform opposite the first location.

7. The apparatus of claim 1, wherein the bent gimbal structure is constructed from a first material, the platform is constructed from a second material, and the first material is heavier than the second material.

8. The apparatus of claim 1, further comprising a first rotation power unit for rotating the bent gimbal structure about the first axis of rotation.

9. The apparatus of claim 1, further comprising a second rotation unit for rotating the platform about the second axis of rotation.

10. The apparatus of claim 1, further comprising a platform control unit, the platform control unit controlling the bent gimbal structure as it rotates about the first axis of rotation and controlling the platform as it rotates about the second axis of rotation.

11. The apparatus of claim 10, wherein the platform control unit comprises an inertial measurement unit.

12. The apparatus of claim 1, wherein the first pivot joint connects to the bent gimbal structure at a center of the bent gimbal structure.

13. The apparatus of claim 1, wherein the platform comprises at least one of:

a plate for supporting a phased antenna array;

a phased antenna array; and a wireframe structure for supporting a phased antenna array.

14. A system for supporting an antenna comprising:

a base comprising a vertical axis;

a first pivot joint connected to the base;

a bent gimbal structure connected to the first pivot joint, wherein the first pivot joint rotates the bent gimbal structure about a first axis of rotation and the first axis of rotation is substantially orthogonal to the vertical axis, wherein the bent gimbal structure does not rotate about the vertical axis;

a second pivot joint connected to the bent gimbal structure; and a platform connected to the second pivot joint, wherein the second pivot joint rotates the platform about a second axis of rotation, wherein the second axis of rotation is substantially orthogonal to both the first axis of rotation and the vertical axis and the platform does not rotate about the vertical axis, wherein the bent gimbal structure is outside a field of view of an antenna supported by the platform as the platform rotates about the second axis of rotation;

a first rotation power unit operationally coupled to the first pivot joint, the first rotation power unit for rotating the bent gimbal structure about the first axis of rotation;

a second rotation power unit operationally coupled to the second pivot joint, the second rotation power unit for rotating the platform about the second axis of rotation; and a platform control unit in communication with the first rotation power unit and the second rotation power unit, the platform control unit controlling rotation about the first axis of rotation by way of the first rotation power unit and controlling rotation about the second axis of rotation by way of the second rotation power unit.

15. The system of claim 14, wherein the platform control unit comprises an inertial measurement unit.

16. The system of claim 14, wherein the platform control unit is coupled to the platform.

17. The system of claim 14, wherein the bent gimbal structure extends below the first axis of rotation and the second axis of rotation.

18. The system of claim 14, wherein the second pivot joint comprises a first pivot sub-joint and a second pivot sub-joint, the first pivot sub-joint connected to a first end of the bent gimbal structure and the second pivot sub-joint connected to a second end of the bent gimbal structure.

19. The system of claim 18, wherein the first pivot sub-joint connects the first end to the platform at a first location of the platform and the second pivot sub-joint connects the second end to the platform at a second location of the platform opposite the first location.

20. An apparatus for supporting an antenna comprising:

a base comprising a vertical axis;

a first pivot joint connected to the base;

a bent gimbal structure connected to the first pivot joint, the bent gimbal structure comprising a first end and a second end opposite the first end, wherein the first pivot joint rotates the bent gimbal structure about a first axis of rotation and the first axis of rotation is substantially orthogonal to the vertical axis, wherein the bent gimbal structure does not rotate about the vertical axis;

a second pivot joint comprising a first pivot sub-joint and a second pivot sub-joint, the first pivot sub-joint connected to the first end of the bent gimbal structure and the second pivot sub-joint connected to the second end of the bent gimbal structure; and a platform connected to the second pivot joint, wherein the first pivot sub-joint connects the first end to the platform at a first location of the platform and the second pivot sub-joint connects the second end to the platform at a second location of the platform opposite the first location, wherein the second pivot joint rotates the platform around a second axis of rotation, the second axis of rotation orthogonal to the first axis of rotation and the vertical axis, wherein the platform does not rotate about the vertical axis of rotation and the bent gimbal structure is outside a field of view of a phased antenna array supported by the platform as the platform rotates about the second axis of rotation.

* * * * *